United States Patent [19]

Yeh

[11] Patent Number: 4,988,228

[45] Date of Patent: Jan. 29, 1991

[54] BRUSH WITH EXTENDIBLE AND RETRACTABLE BRISTLE ELEMENTS

[76] Inventor: Ching-Yuan Yeh, No. 39, Lane 300, Tun Hua S. Rd., Taipei, Taiwan

[21] Appl. No.: 499,168

[22] Filed: Mar. 26, 1990

[51] Int. Cl.[5] ..... A46B 11/06; A46B 7/06; A45D 24/16

[52] U.S. Cl. ..... 401/289; 15/160; 15/184; 132/116; 132/121; 132/123; 401/287

[58] Field of Search ..... 132/112–116, 132/119–121, 123, 143, 212, 313; 15/184, 159 R, 201, 202, 203, 168, 169, 186, 104.5; 119/88; 401/286, 287, 289

[56] References Cited

U.S. PATENT DOCUMENTS

| | | | |
|---|---|---|---|
| 1,686,936 | 10/1928 | Simpson | 132/114 |
| 3,754,557 | 8/1973 | Moore | 132/114 |
| 4,527,576 | 7/1985 | Chou | 132/123 |
| 4,574,416 | 3/1986 | Stewart et al. | 119/88 |

FOREIGN PATENT DOCUMENTS

| | | | |
|---|---|---|---|
| 2174593 | 11/1986 | United Kingdom | 132/123 |

*Primary Examiner*—Harvey C. Hornsby
*Assistant Examiner*—Charles E. Cooley
*Attorney, Agent, or Firm*—Marshall & Melhorn

[57] ABSTRACT

A brush includes a housing unit and a bristle plate disposed within the housing unit. The bristle plate has a plurality of parallel bristle elements projecting downward therefrom. A guide unit guides the bristle elements to move through the bristle holes of the housing unit. A resilient unit biases the bristle plate to move upward in the housing unit, so as to retract the bristle elements into the housing unit. A bristle-pushing member includes a generally inverted U-shaped body riding on the bristle plate, a rotating shaft provided on the body and journalled in the housing unit, a rotary lever connected securely to an end of the body, and a push lever connected securely to the other end of the body. Rotation of the rotary lever moves the bristle elements between an extension position and a retraction position. When the bristle elements are at the extension position, the rotary lever can be moved to engage within the retaining groove of the housing unit, so as to lock the bristle elements relative to the housing unit. Actuation of the push lever disengages the rotary lever from the retaining groove of the housing unit. A bias element biases the rotary lever to engage within the retaining groove of the housing unit when the bristle elements are at the extension position.

2 Claims, 4 Drawing Sheets

BRUSH WITH EXTENDIBLE AND RETRACTABLE BRISTLE ELEMENTS

BACKGROUND OF THE INVENTION

This invention relates to a brush, more particularly to a brush with extendible and retractable bristle elements.

The improvement of this invention is directed to the conventional brush shown in FIG. 1, which includes a lower housing 90, a bristle plate 91, a crank type rotary lever 92, a hair-separating needle 93, and an upper housing 94. The bristle plate 91 has a plurality of bristle elements 95. A guide plate 97 has a plurality of guide holes 971 in alignment with the bristle elements 95 and the bristle holes 901 of the lower housing 90. A position-limiting plate 98 is connected securely to the guide plate 97 by means of four guide posts 981, so as to move the bristle plate 91 between the guide plate 97 and the position-limiting plate 98. Two springs 982 (only one is shown) interconnect two sides of the bristle plate 91 and two sides of the guide plate 97, so as to push the bristle plate 91 upward to press against the position-limiting plate 98, thereby retracting the bristle elements 95 into the housing unit, which consists of the lower housing 90 and the upper housing 94. The rotary lever 92 is placed between the bristle plate 91 and the position-limiting plate 98 at one end thereof and confined by a curved retainer 902 within the notch 903 of the lower housing 90 at the other end thereof. In use, the rotary lever 92 is rotated to push the bristle plate 91 downward by the crank portion 922 of the rotary lever 92, so as to extend the bristle elements 95 from the housing unit 90, 94 through the guide holes 971 of the guide plate 97 and the bristle holes 901 of the lower housing 90. At the same time, the tongue 961 of a push lever 96 engages within the groove 921 of the rotary lever 92, so as to prevent the rotation of the rotary lever 92. A short spring 962 biases the tongue 961 to engage within the groove 921. When the user desires to separate two tangled strands of hair, the push lever 96 is actuated to disengage the tongue 961 from the groove 921 of the rotary lever 92, so that the springs 982 retract the bristle elements 95 into the housing unit 90, 94. A rotary knob 99 includes a fixed pinion 991 meshing with the rack 931 of the needle 93. Actuation of the rotary knob 99 extends the needle 93 from the hole 941 of the upper housing 94. The inner end 1001 of a generally zigzag pawl member 100 is pushed to catch the serrated portion 932 of the needle 93 by spring action, so as to prevent the movement of the needle 93 relative to the housing unit 90, 94. When the outer end 1002 of the pawl member 100 is pressed, the pawl portion 1001 separates from the needle 93, so that the needle 93 retracts into the housing unit 90, 94 by the action of a long spring 933 which is sleeved on the needle 93. The release of the outer end 1002 of the pawl member 100 locks the needle 93 relative to the housing unit 90, 94. It is easy for this complicated brush to malfunction.

SUMMARY OF THE INVENTION

It is therefore the main object of this invention to provide a simple brush which has a plurality of extendible and retractable bristle elements.

According to this invention, a brush includes a housing unit and a bristle plate disposed within the housing unit. The bristle plate has a plurality of parallel bristle elements projecting downward therefrom. A guide unit guides the bristle elements to move through the bristle holes of the housing unit. A resilient unit biases the bristle plate to move upward in the housing unit so as to retract the bristle elements into the housing unit. A bristle-pushing member includes a generally inverted U-shaped body riding on the bristle plate, a rotating shaft provided on the body and journalled in the housing unit, a rotary lever connected securely to an end of the body, and a push lever connected securely to the other end of the body. Rotation of the rotary lever moves the bristle elements between an extension position and a retraction position. When the bristle elements are at the extension position, the rotary lever can be moved to engage within the retaining groove of the housing unit so as to lock the bristle elements relative to the housing unit. Actuation of the push lever disengages the rotary lever from the retaining groove of the housing unit. A bias element biases the rotary lever to engage within the retaining groove of the housing unit when the bristle elements are at the extension position.

BRIEF DESCRIPTION OF THE DRAWING

Other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
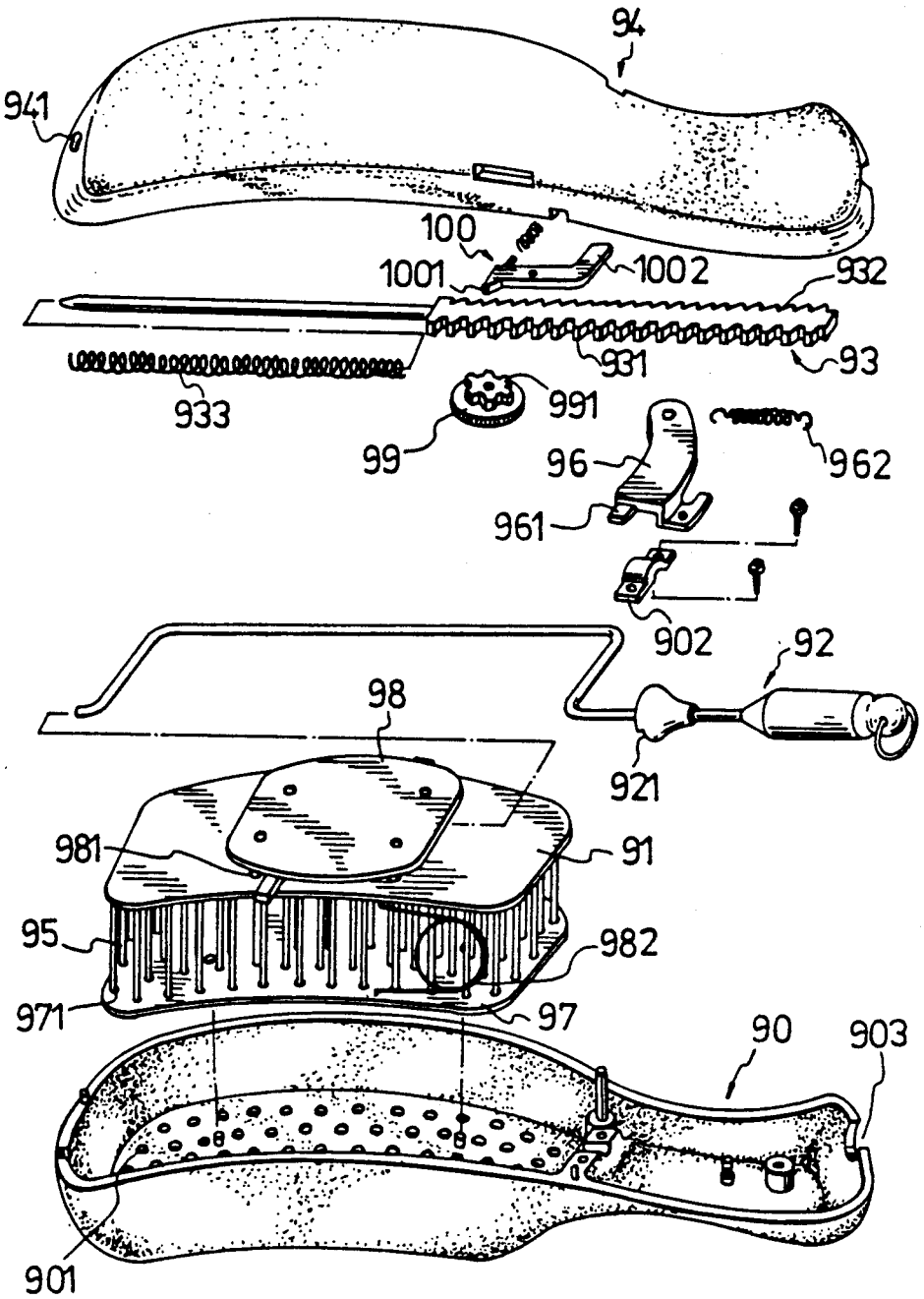
PRIOR ART FIG. 1
FIG. 1 is an exploded view of a conventional brush.
Figure 2:
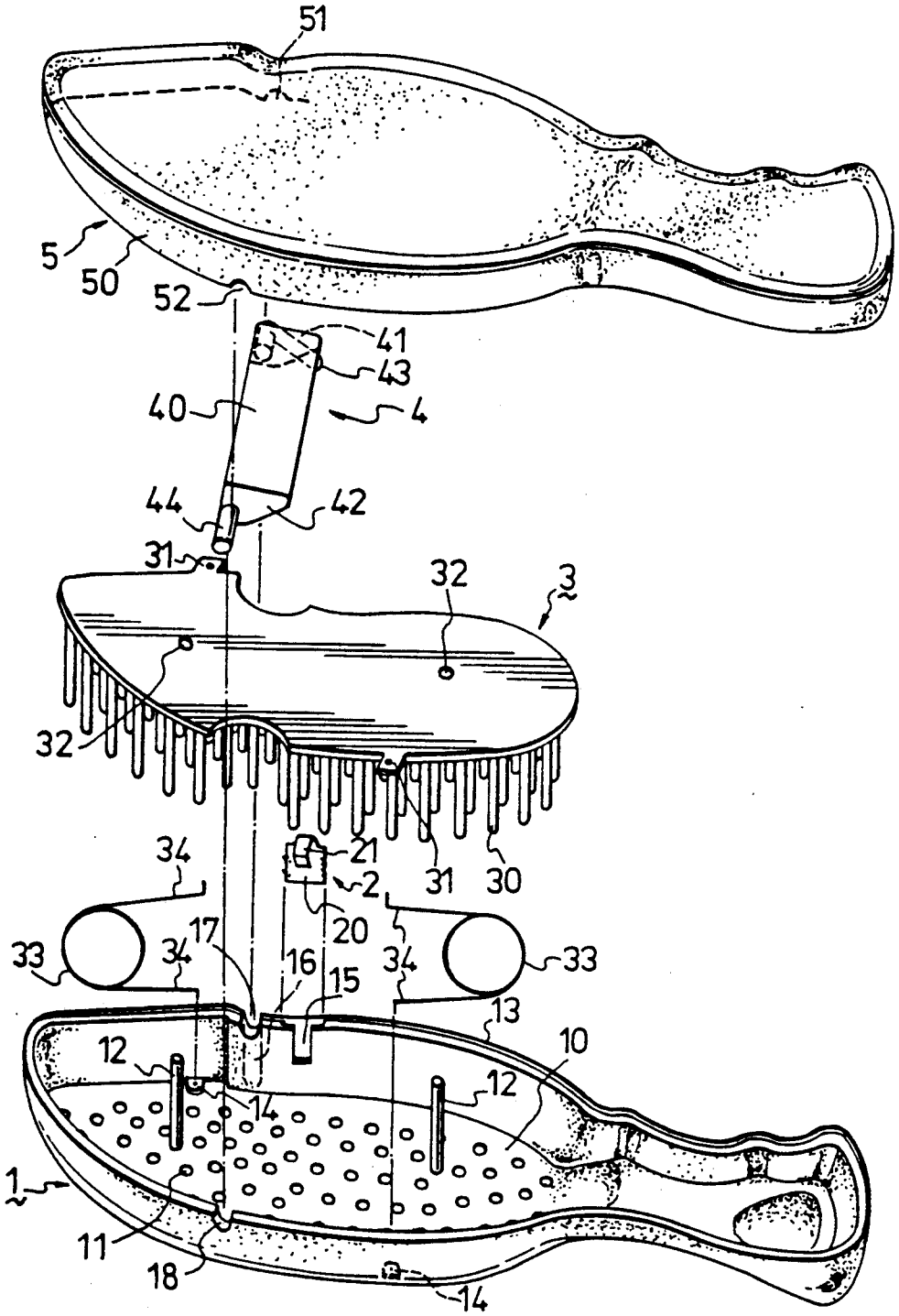
FIG. 2 is an exploded view of a brush according to this invention.

Referring to FIG. 2, a brush of this invention includes a lower housing 1, a bias element 2, a bristle plate 3, a bristle-pushing member 4 and an upper housing 5.

The lower housing 1 includes a bottom wall 10 having a plurality of bristle holes 11 formed therethrough, two guide posts 12 protruding upward from the bottom wall 10, a peripheral wall 13, two fastening holes 14 formed in two sides of the bottom wall 10, a positioning groove 15 formed in the upper surface of the peripheral wall 13, and a retaining groove 16 formed in the outer surface of the peripheral wall 13.

Figure 2A:
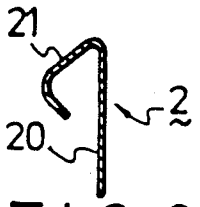
FIG. 2A is a sectional view showing the bias element of the brush according to this invention.

The bias element or spring sheet 2 includes a base portion 20 inserted tightly into the positioning groove 15 of the peripheral wall 13, and a generally V-shaped push portion 21 (see FIG. 2A) integrally formed with the top end of the base portion 20.

The bristle plate 3 includes a plurality of bristle elements 30 projecting downward therefrom in alignment with the bristle holes 11 of the bottom wall 10, two fastening holes 31 formed in two sides of the bristle plate 3 in alignment with the fastening holes 14 of the lower housing 1, and two guide holes 32 formed through the bristle plate 3 in alignment with the guide posts 12 of the lower housing 1.

A resilient unit consists of two springs 33, each of which has two connecting arms 34. The connecting arms 34 of each spring 33 are inserted into two vertically aligned fastening holes 14, 31, so as to bias the bristle plate 3 to move upward in the lower housing 1, thereby retracting the bristle elements 30 into the lower housing 1.

Figure 3:
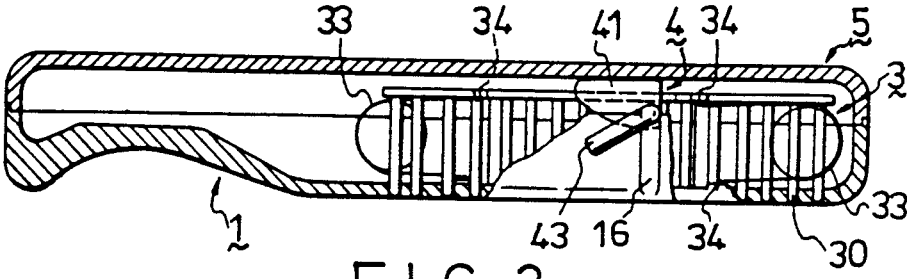
FIG. 3 is a schematic sectional view illustrating the retraction position of the brush according to this invention.
Figure 4:
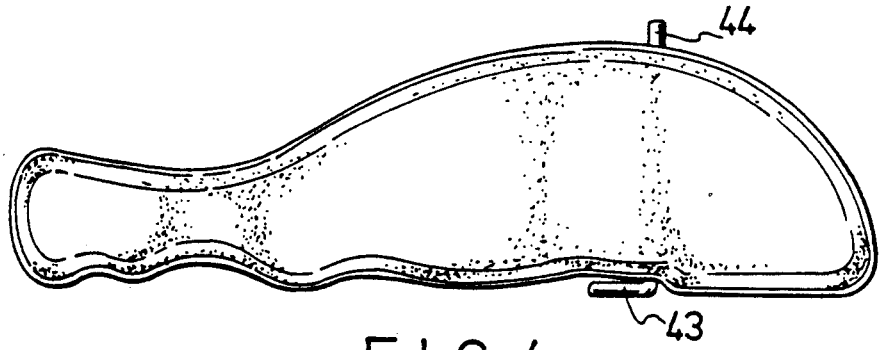
FIG. 4 is a top view showing the brush of this invention.

The bristle-pushing member 4 includes a generally inverted U-shaped body 40 riding on the bristle plate 3, two rotating shafts projecting outward from the side walls 41, 42 of the body 40 which are journalled in two holes constructed by the notches 17, 18 of the lower housing 1 and the notches 51, 52 of the upper housing 5, a rotary lever 43 connected securely to an end of the body 40, and a push lever 44 connected securely to the other end of the body 40. Rotation of the rotary lever 43 moves the bristle elements 30 between the extension position shown in FIG. 6 and the retraction position shown in FIG. 3.

Figure 6:
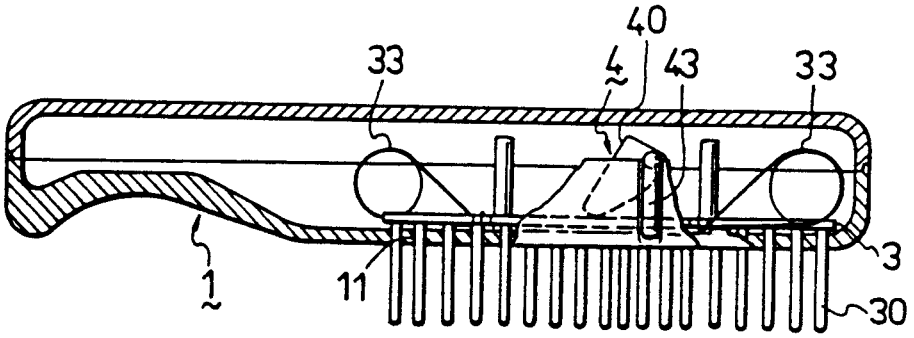
FIG. 6 is a schematic sectional view illustrating the extension position of the brush according to this invention.
Figure 7:
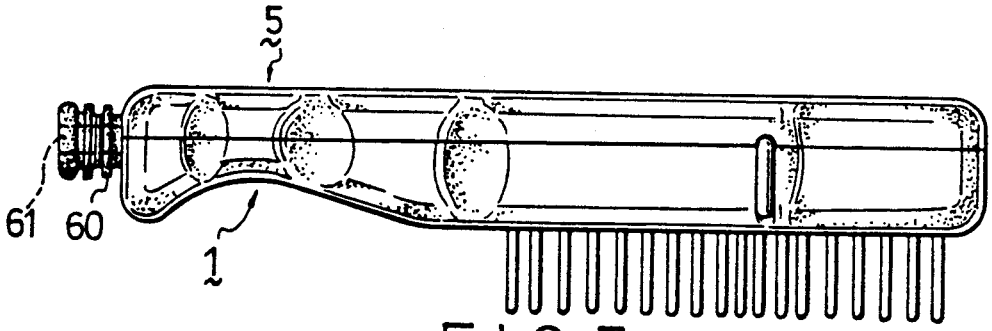
FIG. 7 illustrates another embodiment of the brush according to this invention.

In use, the rotary lever 43 is rotated to the position shown in FIG. 6, so that the body 40 of the bristle-pushing member 4 impels the bristle plate 3 downward, thereby moving the bristle elements 30 to the extension position.

Figure 5:
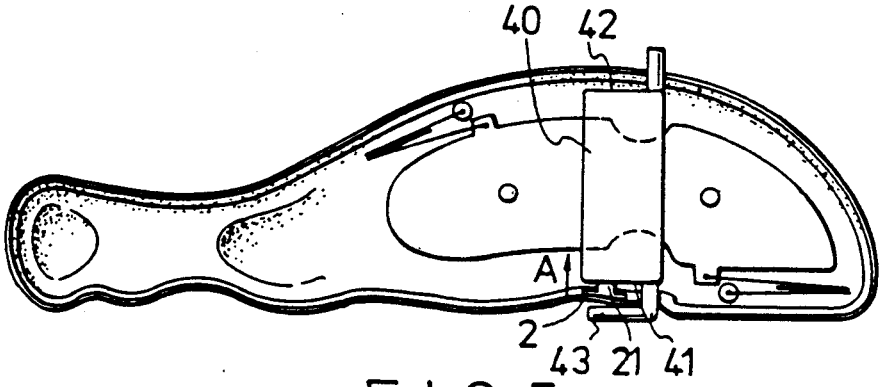
FIG. 5 is a view similar to FIG. 4, in which the upper housing is removed.

When the rotary lever 43 rotates to the position shown in FIG. 6 in which the bristle elements 30 are at the extension position, the push portion 21 of the bias element 2 biases the bristle-pushing element 4 to move in the direction indicated by the arrow (A) (see FIG. 5), so as to engage the rotary lever 43 within the retaining groove 16 of the lower housing 1, thereby preventing the rotation of the rotary lever 43. Accordingly, the bristle elements 30 are locked at the extension position relative to the housing unit 1, 5.

After use, the push lever 44 of the bristle-pushing member 4 is pressed to disengage the rotary lever 43 from the retaining groove 16 of the lower housing 1, so as to retract the bristle elements 30 into the lower housing 1 by the action of the springs 33.

Alternatively, an adapter 60 may be connected removably to the housing unit 1, 5 and has a water passage 61 formed therethrough in communication with the interior of the housing unit 1, 5. A water hose (not shown) can be coupled with the housing unit 1, 5 by means of the adapter 60, so as to enable water to flow along the bristle elements 30 onto the hair of the user.

With this invention thus explained, it is apparent that numerous modifications and variations can be made without departing from the scope and spirit of this invention. It is therefore intended that this invention be limited only as indicated in the appended claims.

I claim:

1. A brush comprising:

a housing unit having a top wall, a bottom wall having a plurality of bristle holes formed therethrough, a peripheral wall interconnecting peripheries of said top and bottom walls, and a retaining groove formed in an outer surface of said peripheral wall;

a bristle plate disposed within said housing unit and including a plurality of bristle elements projecting downward therefrom;

a guide unit for guiding said bristle elements to move through said bristle holes of said housing unit;

a resilient unit biasing said bristle plate to move upward in said housing unit, so as to retract said bristle elements into said housing unit;

a bristle-pushing member including a generally inverted U-shaped body riding on said bristle plate, a rotating shaft provided on said body and journalled in said housing unit, a rotary lever connected securely to an end of said body, and a push lever connected securely to the other end of said body, rotation of said rotary lever moving said bristle elements between an extension position and a retraction position, said rotary lever engaging said retaining groove of said housing unit for preventing rotation of said rotary lever when said bristle elements are at said extension position, actuation of said push lever disengaging said rotary lever from said retaining groove of said housing unit for permitting rotation of said rotary lever; and a bias element biasing said rotary lever to engage within said retaining groove of said housing unit when said bristle elements are at said extension position.

2. A brush as claimed in claim 1, wherein said housing unit includes an adapter connected removably thereto, said adapter having a water passage formed therethrough in communication with interior of said housing unit; whereby, a water hose can be coupled with said housing unit by means of said adapter, so as to enable water to flow along said bristle elements onto hair of a user.

* * * * *